US009227094B2

(12) United States Patent
Poldmaa

(10) Patent No.: US 9,227,094 B2
(45) Date of Patent: Jan. 5, 2016

(54) HEIGHT SAFETY ANCHOR

(71) Applicant: H2FLO Pty Ltd, Hawks Nest (AU)

(72) Inventor: Arvo Poldmaa, Hawks Nest (AU)

(73) Assignee: H2FLO Pty Ltd, Hawks Nest, New South Wales (AU)

( * ) Notice: Subject to any disclaimer, the term of this patent is extended or adjusted under 35 U.S.C. 154(b) by 0 days.

(21) Appl. No.: 14/322,770

(22) Filed: Jul. 2, 2014

(65) Prior Publication Data

US 2014/0346314 A1 Nov. 27, 2014

Related U.S. Application Data

(63) Continuation-in-part of application No. 13/604,464, filed on Sep. 5, 2012, now Pat. No. 9,021,749.

(51) Int. Cl.

| | |
|---|---|
| ***A47G 29/02*** | (2006.01) |
| ***A62B 35/04*** | (2006.01) |
| ***A62B 35/00*** | (2006.01) |
| ***E04G 21/32*** | (2006.01) |

(52) U.S. Cl.

CPC ..... *A62B 35/04* (2013.01); *A62B 35/0068* (2013.01); *A62B 35/0075* (2013.01); *E04G 21/328* (2013.01); *E04G 21/329* (2013.01); *E04G 21/3295* (2013.01)

(58) Field of Classification Search

CPC ..... E04G 21/32; E04G 21/328; E04G 21/329; E04G 21/3295; E04D 13/12; A62B 35/04; A62B 35/0068; A62B 35/0075

See application file for complete search history.

(56) References Cited

U.S. PATENT DOCUMENTS

| | | | | |
|---|---|---|---|---|
| 3,444,957 | A | 5/1969 | Gilpin | |
| 5,113,981 | A | 5/1992 | Lantz | |
| 5,174,410 | A | 12/1992 | Casebolt | |
| 5,730,407 | A * | 3/1998 | Ostrobrod | 248/237 |
| 6,085,802 | A | 7/2000 | Silberberg | |
| 6,098,746 | A | 8/2000 | Castaneda et al. | |
| 7,665,248 | B2 | 2/2010 | Blackford | |
| 9,021,749 | B2 | 5/2015 | Poldmaa | |

(Continued)

FOREIGN PATENT DOCUMENTS

| | | |
|---|---|---|
| AU | 2008100234 A4 | 3/2008 |
| AU | 2009210368 A1 | 3/2010 |

(Continued)

OTHER PUBLICATIONS

Patent Examination Report No. 3 from AU Patent Application No. 2012216652 dated May 14, 2015.

(Continued)

*Primary Examiner* — Amy Sterling
(74) *Attorney, Agent, or Firm* — Traskbritt, P.C.

(57) ABSTRACT

A height safety anchor for fitment to a building support structure, the height safety anchor comprising: first attachment means for fitment to the building support structure; second attachment means remote from the first attachment means for attaching safety equipment; and shock absorbing means having a deformable region extending between the first and second attachment means in a first length when not subject to a deformation force corresponding to a critical sudden load, the shock absorbing means lying substantially in a single plane and comprising a substantially rigid structure that, when subject to the critical sudden load, deforms, elongating to a greater length than the first length.

18 Claims, 8 Drawing Sheets

(56) References Cited

U.S. PATENT DOCUMENTS

| | | | |
|---|---|---|---|
| 2013/0056608 | A1 | 3/2013 | Poldmaa |
| 2013/0168528 | A1 | 7/2013 | Patton et al. |
| 2013/0277519 | A1 | 10/2013 | Poldmaa |

FOREIGN PATENT DOCUMENTS

| | | | |
|---|---|---|---|
| AU | 2012216652 | A1 | 9/2011 |
| CA | 2157947 | A1 | 4/1996 |
| EP | 1762275 | | 3/2007 |
| FR | 2857601 | | 1/2005 |
| GB | 964096 | | 7/1964 |
| GB | 1536354 | | 12/1978 |
| GB | 2084691 | A | 4/1982 |
| GB | 2330169 | A | 4/1999 |
| GB | 2396195 | A | 6/2004 |
| GB | 2426563 | A | 11/2006 |
| NZ | 238211 | | 10/1993 |
| NZ | 590186 | | 3/2012 |
| WO | 9529738 | | 11/1995 |
| WO | 9737876 | | 10/1997 |
| WO | 0146601 | | 6/2001 |
| WO | 03047700 | | 6/2003 |
| WO | 2010000035 | | 1/2010 |

OTHER PUBLICATIONS

PCT International Search Report, PCT/AU2009/00862, dated Sep. 8, 2009.

* cited by examiner

HEIGHT SAFETY ANCHOR

CROSS-REFERENCE TO RELATED APPLICATION

This application is a continuation in part of co-pending application U.S. patent application Ser. No. 13/604,464, filed Sep. 5, 2012, which claims priority 35 U.S.C. §119 to Australian Patent application 2011 903582, filed Sep. 5, 2011, the entire contents of each of which are incorporated herein by reference. This application also incorporates by reference Australian patent application No. 2012216652 and New Zealand patent application No. 602265.

TECHNICAL FIELD

The application relates to a height safety anchor for attaching devices, apparatus or equipment to a roof surface and, more particularly, to a height safety anchor for fitment to a building structure clad with metal sheeting, the height safety anchor also including shock absorbing means. The devices, apparatus or equipment to be attached may include safety equipment such as safety harnesses, ropes or other safety devices adapted to secure a height safety worker against falling and injury.

While the disclosure derives particular advantage when used in conjunction with a metal roof, it may also be utilized with any roof where access to the structure supporting the cladding is feasible and accordingly no limitation is implied by a primary reference to metal roofs in the following description.

BACKGROUND

The following references to and descriptions of prior proposals or products are not intended to be, and are not to be construed as, statements or admissions of common general knowledge in the art. In particular, the following prior art discussion does not relate to what is commonly or well known by the person skilled in the art, but assists in the understanding of the inventive step of the disclosure of which the identification of pertinent prior art proposals is but one part.

Several solutions have been proposed for providing anchor points on a roof or building structure, but these are normally intended for permanent fitment. Such anchor points are made available so that a person working on the roof or other building structure, for example, can attach himself to the anchor point by means of a rope or cable, etc., so that in the event of a fall, he will be constrained from falling off the building.

Thus, conventional height safety anchoring devices for permanent fitment require access to the building support structure such as a batten or rafter. Direct access to the support structure is generally required and involves mounting the height safety anchor prior to the application of the external covering of the roof such as tiles, sarking, sheeting or other cladding so that upon application of the external covering to the support structure, the height safety anchor extends beyond the external covering. The anchor will, of course, need to be suitably flashed to provide a weather-proofed fitment.

On the other hand, if the external covering has already been applied to the building support structure, then at least one unit of the external covering, e.g., a single sheet of covering, must be removed to provide access to the building support structure. Thus, for example, where large units of sheeting form the external covering of the roof, considerable time and effort may have to be expended to remove a single unit to gain access to the roof support structure. Furthermore, there is also a risk that damage to the covering may occur or, more particularly, once it is re-laid, the covering might not properly seal against the elements.

However, the removal of the covering as described above may be impractical or inconvenient. Alternatively, so-called retro-fit systems have been developed that provide a solution for securing a permanent anchor point by using a tool through an access facility, i.e., a relatively small opening, for example, which is then later sealed.

In any event, all of the foregoing solutions have as their basic premise that the anchor is left permanently in place once fitted. This, however, may not be convenient or even desirable having regard to aesthetic considerations and may be unnecessarily wasteful as there may be little need for an anchor point at any time in at least the foreseeable future. Furthermore, anchor points may be desired at various locations, particularly as work progresses on a site, once again adding to the total cost if several permanent anchors are utilized.

To this end, a solution that provides for an anchor point, especially one that could be fitted to a metal roof and removed after any necessary work has been completed, would be advantageous. A useful solution to this problem, therefore, presents itself when one takes into account the typical way in which a metal roof is constructed. Typically, metal cladding is affixed with screws at intervals along a batten, which, in turn, is affixed to rafters in typical fashion. A solution is, therefore, available by simply removing sufficient screws from a section of cladding and affixing a suitable temporary anchor over the cladding by replacing the existing screws using the existing holes through the cladding. Thus, the screws would then pass through suitable holes in the temporary anchor and through the existing holes in the cladding and, thence, into the supporting structure below. Upon completion of the work, the screws can then be removed again, the temporary anchor removed, and the screws replaced once more to hold the cladding in place as it was originally affixed.

In this way, there would be no need to disturb the roof structure or cladding in any way other than to remove some of the existing screws in order to attach the temporary anchor, the screws being replaced after the necessary work on the roof has been completed and the temporary anchor has been removed.

This would provide a simple, useful and economic solution to the problem of providing a temporary anchor point for safety equipment and the like, which could then be readily removed once the work was completed. The temporary anchor could then be used at another location on the same site or taken away altogether and used on another site.

Of course, such a solution would still need to be effective in ensuring adequate safety standards are met, that is to say, the anchor itself, in conjunction with its fitment, would need to meet the necessary safety standards. It should be stressed that anchors that have hitherto been suitable for permanent fitment do not lend themselves to attachment as temporary anchors in this way.

The original disclosure (from which this application claims priority), therefore, advantageously provided a temporary anchor that could not only to meet the desired safety standards, but that was itself designed to be portable so that it could be easily taken from one work site to another.

However, it would also be advantageous to provide a height safety anchor that could be optionally permanently affixed directly to a supporting building structure, e.g., for a metal clad roof, by affixing the anchor through the metal cladding at points already utilized for screwing the cladding to the structure, without otherwise disturbing the metal cladding itself.

It would also be further advantageous if such a height safety anchor system was provided with shock-absorbing means in order to minimize injury from a person utilizing the anchor point in the event of a fall. Further, it would also be desirable if the anchor point were multi-directional to the extent that it worked efficiently no matter from which direction forces might be applied in the event of a fall.

In addition, it would also be advantageous if such an anchor could also be fitted directly to any stable structure, including the supporting structure for a tile roof, albeit with the necessity of removing some tiles or other cladding, etc., to allow access to the underlying structure where applicable.

SUMMARY OF THE DISCLOSURE

Provided is a height safety anchor especially for metal clad roofs which ameliorates one or more of the aforementioned disadvantages associated with the prior art, particularly by providing an anchor point that may be mounted directly over the metal roof cladding, utilizing the existing fixing points for the metal cladding itself, the anchor being so constructed as to progressively absorb the effects of a sudden load applied thereto, and wherein the anchor functions usefully in all directions.

It should also be understood that while the disclosure relates primarily to the attachment of an anchor to a roof as described, it will also be applicable in many other instances where attachment of a device to another surface or structure is required, whether a wall or ceiling, for example. Thus, any reference to a roof, whether metal or otherwise, is also meant to encompass reference to any structure, where, by suitable adaptation, the device may also be utilized.

Provided is a height safety anchor for fitment to a building support structure, the height safety anchor comprising:

first attachment means for fitment to the building support structure by engagement to a flexible and high tensile elongate member comprising a plurality of spaced eyelets that are slidable along the elongate member;

second attachment means remote from the first attachment means for attaching safety equipment; and shock absorbing means having a deformable region extending between the first and second attachment means in a first length when not subject to a deformation force corresponding to a critical sudden load, the shock absorbing means lying substantially in a single plane and comprising a substantially rigid structure that, when subject to the critical sudden load, deforms, elongating to a greater length than the first length.

The elongate member may be in the form of a cable. The cable should be relatively flexible in the sense that it can sustain some bending over a portion of its length. The cable should have high tensile strength. The cable may be made from metal or plastic rope. The cable may be formed from galvanized iron, steel and the like materials. It is strongly preferred that the cable is formed from and comprises stainless steel cable. Care should be taken to meet safety standards in fitting any height safety equipment.

The slidable eyelets may comprise a loop surrounding a portion of the cable. The loop may be a sleeve formed from a plate pressed onto and around the cable. The eyelets may, therefore, be formed from any number of metal working methods. The eyelets may be formed from stamped plates or, preferably, by laser cutting. The flat plates so formed are then pressed into shape to form a loop section about the cable. The plate is preferably folded back on itself.

The eyelet may comprise a tab portion include an aperture for receiving a fastener and a folded portion. The folded portion may form a tongue plate that wraps back around the cable with one end of the tongue attached to the tab and the other end adapted to wrap around so that it abuts, or rests close to, the transition or junction between the tab and the tongue plate.

The eyelet may be bisymmetrical and the tongue plate may terminate at each end with a tab comprising an aperture for receiving a fastener. The eyelet is, therefore, preferably adapted to fold generally or substantially symmetrically. Each eyelet may comprise a pair of holes, one at each end of the plate, preferably one hole in each of the tabs that register when the plate is pressed about the cable. The pair of holes may receive a fastener, such as a screw or clamp, and by the fastener be secured to the building support structure.

The building support structure may be a roof or wall on or against which elevated work is required to be performed with attendant risks to unsecured workers. Accordingly, the height safety anchor is structurally sufficient to sustain a critical load that free-falls from work on a vertical structure, such as a building wall. However, more typically, the height safety anchor will be deployed in securing a worker to a roof structure, such as a metal clad and/or timber frame roof. In its preferred form, therefore, the height safety anchor is a roof anchor. The height safety anchor may be installed temporarily whereby the fasteners are undone and the eyelets released, or alternatively, the height safety anchor may be left permanently installed. Preferably, where permanent installation is required and the height safety anchor is likely to be exposed to the weather, the cable, shock absorber, fasteners and the eyelets will be corrosion resistant and made from the same material, such as galvanized or stainless steel.

The slidability of the eyelets along the cable not only permit adjustability in the positioning of the shock absorber, and, therefore, the second attachment, but also provides for further energy dissipation in the event of the application of a sudden critical load to the second attachment.

The height safety anchor preferably further includes end sockets. The end sockets may comprise a swage sleeve. The end sockets may be formed from cable looped back around or on itself. The aligned cable lengths may be welded or clamped. The end socket may be formed by a cable loop with the cable looped back on itself near its end and swaged. The end sockets preferably comprise eyelet bolts threaded into swaged end sleeves.

The shock absorbing means may include the second attachment in the form of a large ring. The shock absorbing means may also include a series of folded portions forming a concertinaed length, one end of which connects to one side of the large ring so that one section of the ring is positioned adjacent a straight edge of the last portion of folded length of the series of folded portions.

The shock absorbing means may engage the elongate member by feeding a length of the elongate member through a pair of spaced holes formed in an end plate of the shock absorbing means. Preferably, the end of the concertinaed length opposed to the end connected to the large ring is connected to one side of the end plate so that one section of end plate is positioned adjacent a straight edge of the last portion of folded length of the series of folded portions.

The second attachment may be in the form of any suitable height safety equipment. Typically, a D-clamp or carabiner may be used to attach the height safety equipment to the second attachment.

In the basic disclosure, there was provided a roof anchor for fitment to a roof support structure or the like, especially a roof support structure having metal cladding affixed thereto, wherein the anchor is provided with a first attachment means for fitment of the roof anchor to the roof support structure, a second attachment means remote therefrom for attaching devices, apparatus or equipment, especially safety equipment, thereto, and shock-absorbing means located therebetween so as to progressively distort under sudden load, and wherein the first attachment means comprises a webbing material having a plurality of spaced apart fixing points by means of which the webbing material may be affixed to the roof support structure utilizing the existing fixing means that hold the metal cladding to the roof structure.

Preferably, the shock absorbing means is in the form of a metal bar or narrow plate, cut so as form a concertina arrangement that can progressively deform under load. Preferably, the shock absorption is provided by one or more suitably shaped portions of material cut or otherwise formed so that when a force is applied thereto, there is created a deformation therein in the form of a generally linear extension of that portion, i.e., by effectively straightening or "unbending" such region. Thus, the anchor is so designed that deformation by bending, i.e., unbending or straightening, of the shock-absorbing region, in combination with either of the attachment regions as described herein, where appropriate, provides an absorption of the forces applied to the anchor from any angle, that is to say, if a load is exerted from any direction, the anchor is able to accommodate that sudden load in suitable fashion. In this way, the anchor will provide a suitable shock-absorbing means against, for example, a sudden load arising from a person attached thereto falling from the roof.

With advantage, the shock absorbing means in the form described may be covered with a rubber sleeve or similar covering to protect it.

This sleeve may also provide a region where safety instructions may be written.

On the other hand, any suitable shock-absorbing means may be utilized that functions to dampen the forces applied under sudden load, such as when a person attached to the roof anchor falls from the roof.

The devices, apparatus or equipment to be attached may include safety equipment such as safety harnesses, ropes or other safety devices adapted to secure a roof worker against falling and injury. While the devices, apparatus or equipment derives particular advantage when used in conjunction with a metal roof, it may also be utilized with any roof where access to the structure supporting the cladding is feasible and, accordingly, no limitation is implied by a primary reference to metal roofs in the following description.

Although any suitable attachment means may be utilized to affix safety equipment and the like, preferably, the second attachment means by which the safety equipment such as a harness, etc., is attached to the shock-absorbing means is in the form of a simple eye located near its extremity, remote from where it is attached to the roof structure, and through which the safety equipment may be attached in known fashion.

The webbing material providing the attachment means for affixing the anchor to the roof structure in the original disclosure was a polyester webbing capable of supporting a high tensile load, for example, in excess of 10 tonnes. While polyester webbing is the preferred material, any webbing material, including nylon and/or composites, having the ability to withstand similar loads may be employed.

The webbing is a single length of webbing material, although other arrangements adapted to perform as described may be utilized. Where a single length of webbing is employed, it has been found that a suitable length is around 1.5 m to 2.5 m in length, preferably about 2 meters to 2.2 meters. With advantage, this length of webbing can be inserted through a slot provided in the end of the shock-absorbing means remote from the end having the means to attach the safety devices, etc., thereto. In this way, the webbing may extend for approximately equal lengths either side of the slot. By affixing the webbing to the roof structure at either side of the slot, allows for the shock-absorbing means to move to some extent between at least the first fixing points located adjacent to and either side of the slot located in the end of the shock absorber. This allows the anchor to function effectively in all directions.

Preferably, the fixing points in the webbing are holes. More preferably, the fixing points are reinforced holes, formed in the webbing.

The preferred method of attaching the webbing to the roof structure in the original disclosure was by utilizing screws inserted through the holes in the webbing and into the supporting structure of the roof material. However, other forms of fixing may also be utilized, as discussed below, and no limitation should be inferred from a general reference to screws as the medium by which the webbing is attached to the roof.

Six such holes may be provided in the webbing material, so as to spread the load, as described later herein. Under conditions where a fall occurs, successive screws will take the load and should the first screws adjacent the shock-absorbing means fail, successive screws will then take up the load, causing a diminishing of the forces as the fall progresses. While six holes has been found to be most preferable, other numbers of holes may be employed, although it will be appreciated they will generally be in pairs, to provide an equal number of holes either side of where the webbing attaches to the shock-absorbing means. In its most simplest form, of course, even one hole may suffice where the length of webbing is, for example, simply looped back on itself and joined. However, given that safety considerations are paramount, it is preferred to utilize additional holes to provide additional attachment points should those closest to the shock-absorbing means fail. Thus, it is preferred to have at least four holes and, more preferably, at least six, where a single length of webbing is passed through a slit in the end of the shock-absorbing means as described above.

While it is preferred that the shock-absorbing means has sufficient energy-absorbing capability so as to deform under load without allowing any of the screws to pull out, the provision of six holes, i.e., three either side of the slot in the shock absorber, provide for additional safety should the first screws adjacent the shock absorber fail. To provide added safety, six, rather than merely four screws, are recommended.

With advantage the holes in the webbing are provided with metal reinforcements in the form of metal eyelets formed through the web. It is preferred that the holes be formed in the webbing material by spreading the fibers apart rather than cutting through the webbing. On the other hand, any means by which holes are formed may be contemplated. Compensation for reduced strength may be made by widening the amount of material in the webbing, for example. In any event, the metal eyelets then provide suitable reinforcement for such holes through which screws may be fitted, the screws then passing through the original holes in the metal cladding and into the support structure. The metal eyelets protect the webbing when inserting the screws and provide a reinforcement so the head of the screw is constrained from passing through the webbing, either during insertion of the screw or subsequently, should the anchor be subjected to a sudden fall from a person attached thereto.

Conventionally, eyelets are formed by utilizing a two-part construction, there being a male portion and a female portion, such that the male portion has a tubular portion that extends through the hole and is pressed over, i.e., crimped or expanded over, the female portion on the other side, forming a flange after the tubular portion passes through the hole in the female portion.

However, as the webbing required for the original disclosure is of necessity one having a very robust construction, conventional eyelets have been found to be inadequate, generally inadequate especially where relatively thick webbing material is utilized, e.g., greater than about 3 mm in thickness. Again, however, where suitable compensation is otherwise made by, for example, using broader webbing to compensate for a narrower thickness, conventional eyelets may be employed.

In relation to the preferred webbing structure, however, having a thickness in excess of, say, 3 mm, a simple alternative has been developed that involves the use of a three-part eyelet assembly, comprising two identical washers placed either side of the hole with a ferrule passing therethrough, each end of which is then caused to be pressed over both washers, i.e., forming flanges from both sides, in the same way as the tubular portion of a conventional eyelet is pressed on one side as described above, but in this case, doubled here to form each side of the eyelet structure.

With advantage, this eyelet, according to the original disclosure, can be inserted in such heavy webbing material by having a series of spikes mounted along a supporting member, over which the webbing can be forced to first create the required holes by spreading the fibers rather than cutting them. With a washer already located below the hole, i.e., on each spike, it is then a simple matter to slide the ferrule down the spike and force it through the hole, and fit another washer over each spike. A simple press arrangement then squeezes from each side, causing each end of the ferrule to form a flange on either side, which then binds each washer to each side of the respective holes formed in the web, creating an effective three-part metal eyelet having greater robustness than is attainable from a two-part eyelet assembly.

Thus, in typical applications where metal sheeting is affixed to a roof structure with existing screws, when affixing the anchor, the screws that hold the metal cladding are simply removed, the anchor located in position and then held in place utilizing those or other screws, if necessary, by inserting the screws through the holes in the webbing, then passing through the original holes in the metal cladding and thence into the supporting structure, generally a batten. Once the work is completed, the screws may then be removed again, the temporary anchor taken away and the screws refitted to hold the metal cladding in the way it was originally found. Alternatively, the anchor may be left in place permanently, as required.

It is, of course, necessary that the screws hold the anchor firmly and to this extent, a different length of screw (albeit with the same gauge) may need to be utilized to ensure proper penetration into the underlying batten. In the case of a timber batten, it has been found that the screws should penetrate at least 35 mm into the batten. Similarly, it is necessary with metal battens that the screw thread engages properly with the batten to avoid so-called overpassing of the thread as most roofing screws have a blank or unthreaded region below the head of the screw.

However, the disclosure is not meant to be limited to the use of screws as aforementioned and any suitable fixing means may be employed, either by affixing to the underlying roof structure through existing holes or even to the roof sheeting itself, provided the fixing of the sheeting to the underlying structure is sufficiently sound and the means by which the webbing is attached to the sheeting or structure is sufficient to withstand the forces discussed above.

In this regard, for example, so-called Klip Lock roofs do not have holes therethrough but are otherwise "clipped" down. By suitable adaptation, other fixing means that allow the webbing to be attached to such sheeting are, therefore, meant to be within the scope of the disclosure.

By utilizing a webbing material in the original disclosure, having as its major advantage complete flexibility, it will be understood that a variety of metal cladding profiles may thus be accommodated, the excess material between each fixing point, i.e., hole, simply allowed to form a loop between each fixing point. In other words, the use of webbing material allows for simple adjustment to accommodate different profiles of metal cladding and different spacings of screws placed therein, while still providing adequate support for the anchor if subjected to a sudden load.

Alternatively, where the roof support structure supports other than metal cladding, the webbing material may be affixed instead directly to the roof support structure after sufficient roof covering material, for example, tiles, has been removed. In such cases, the screws should be fitted preferably at least 100 mm apart along a rafter or batten. Therefore, although primarily intended for use with a metal roof, the anchor, according to the disclosure, could be fitted to a tiled roof or any other suitable stable structure, by attaching directly to the supporting structure, such as a rafter or batten, after removing one or more tiles as necessary to gain access to the underlying support structure.

Preferably, the webbing of the original disclosure and the way in which it is affixed to the roof support structure and/or the roof cladding as described herein, co-operate with the shock-absorbing means to further assist in minimizing the forces experienced should a fall occur.

It will be understood from the embodiments described herein, that the design as described herein is able to function, irrespective of the direction of the load.

BRIEF DESCRIPTION OF THE DRAWINGS

The disclosure will be better understood from the following non-limiting description of various aspects of an embodiment of the disclosure with reference to the drawings in which:

FIG. 12 is a top view of a metal cladded roof with a height safety anchor installed.

DETAILED DESCRIPTION

Figure 2:
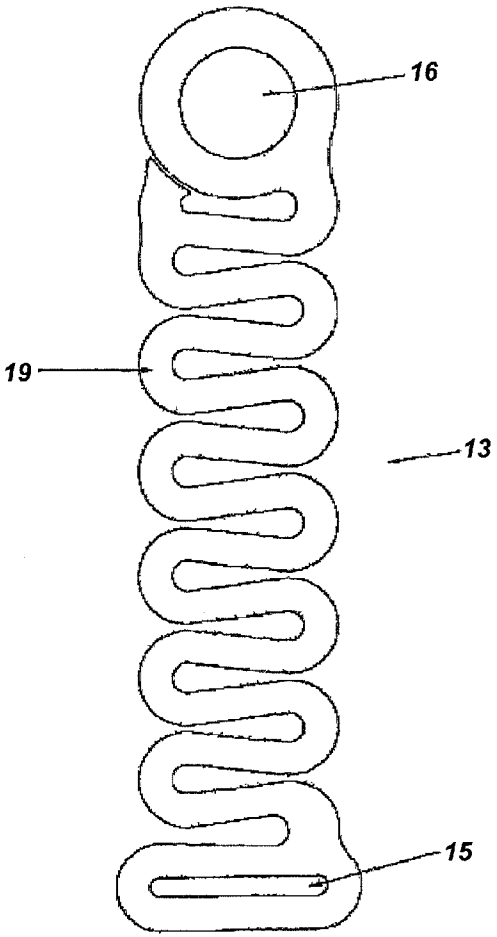
FIG. 2 is a plan view of a suitable energy-absorbing shock absorber for use in the roof anchor shown in FIG. 1.

The webbing is provided with six holes 17 spaced along its length at approximately 300 mm to 400 mm centers. The holes 17 are preferably formed by piercing the webbing 12 to separate the fibers, rather than cutting a hole in the webbing 12 itself, which would weaken the webbing 12 at that point. These holes 17 are further provided with metal eyelets generally referenced 18 to provide reinforcement. The construction of each eyelet 18 is shown in detail in FIG. 3.

Figure 5:
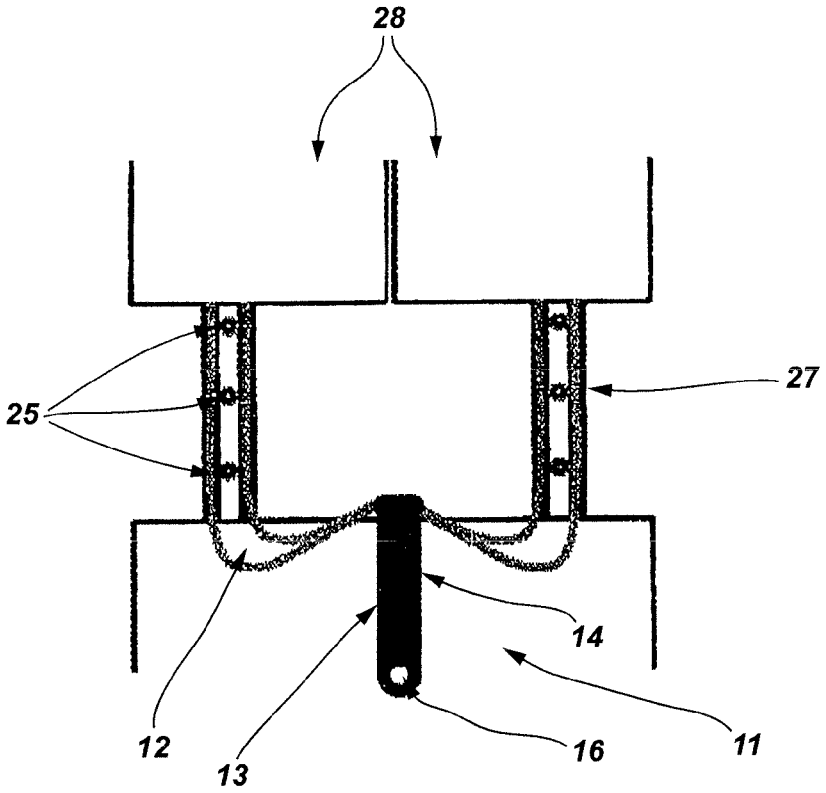
FIG. 5 is a simple plan view of a temporary roof anchor shown in FIG. 1 attached to the rafters of a tiled roof after removal of tiles.
Figure 4:
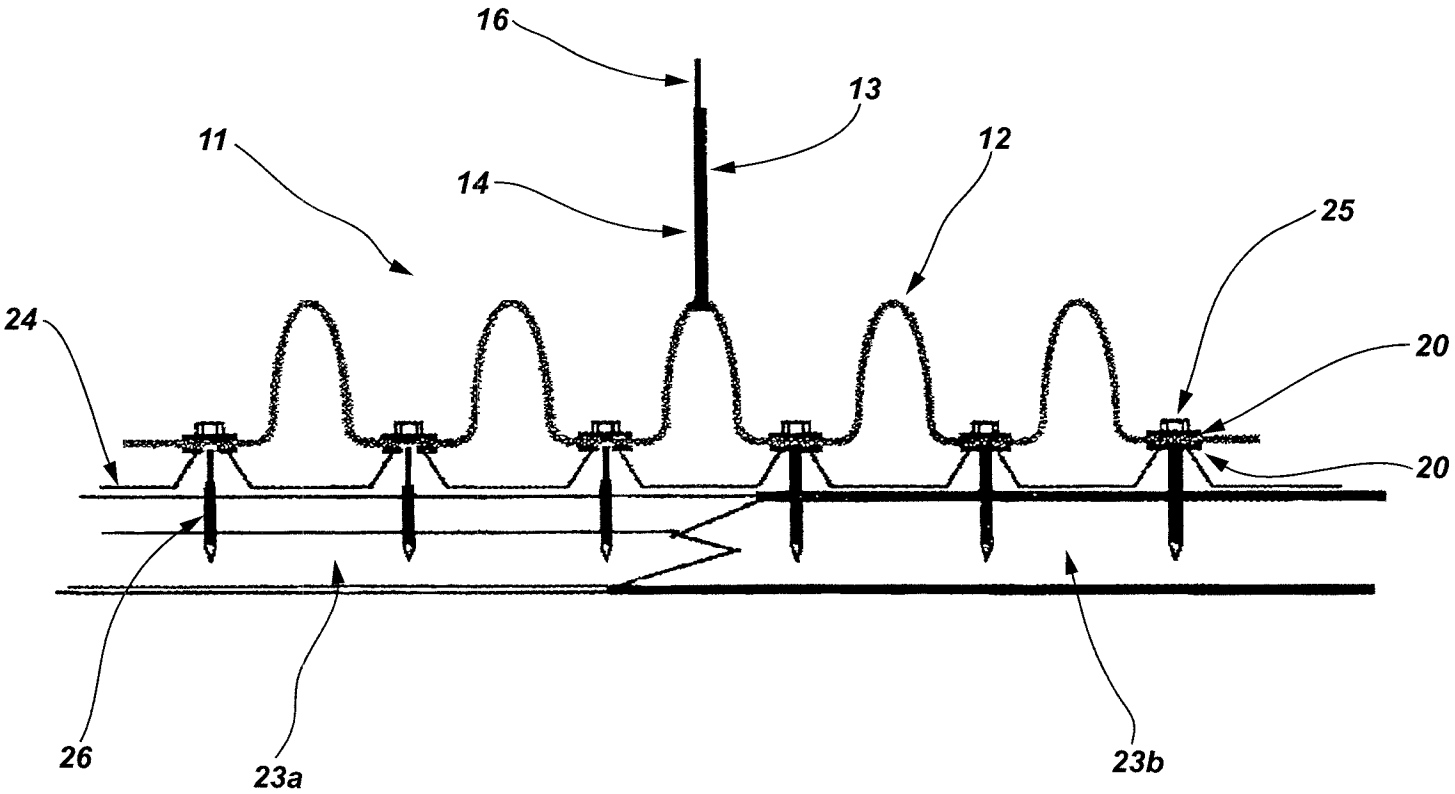
FIG. 4 is a schematic side elevation of a temporary roof anchor shown in FIG. 1 showing it affixed to a metal or timber batten supporting a metal roof cladding.

The holes 17 allow for fixing the temporary anchor 11 to a roof structure as shown in FIGS. 4 and 5.

Referring to FIG. 2, there is shown in detail the shock absorber 13, which is made from a sheet of stainless steel, e.g., 3 mm thick, die out to produce the aforementioned slot 15 at one end for receiving a length of webbing 12 and a hole 16 at the other end to which safety devices such as harnesses and the like may be attached. Therebetween is a region of concertina-like bends, generally referenced 19, formed by die cutting. Upon experiencing a sudden load, such as would occur when a person attached to the temporary roof anchor 11 of which this shock absorber 13 is a part, the shock absorber 13 is caused to extend by, as it were, "unbending," i.e., concertina region 19 straightening out. This action provides for a cushioning of the initial load when it is first applied, thereby effectively diminishing the energy of the load as the deformation progresses.

The sleeve 14, described above, protects the shock absorber 13 and may also be usefully used to display safety instructions, etc.

Figure 1:
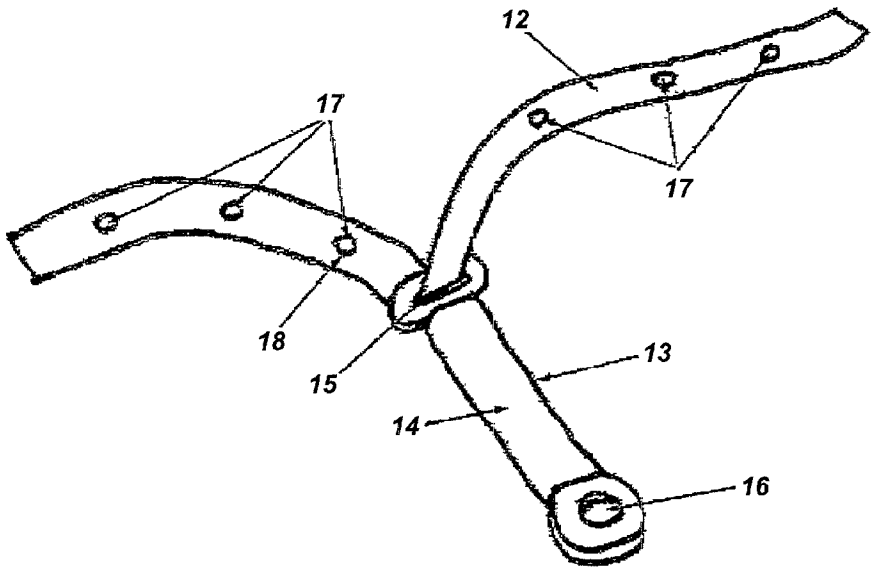
FIG. 1 is a perspective view of a temporary roof anchor according to one embodiment of the original disclosure.
Figure 3:
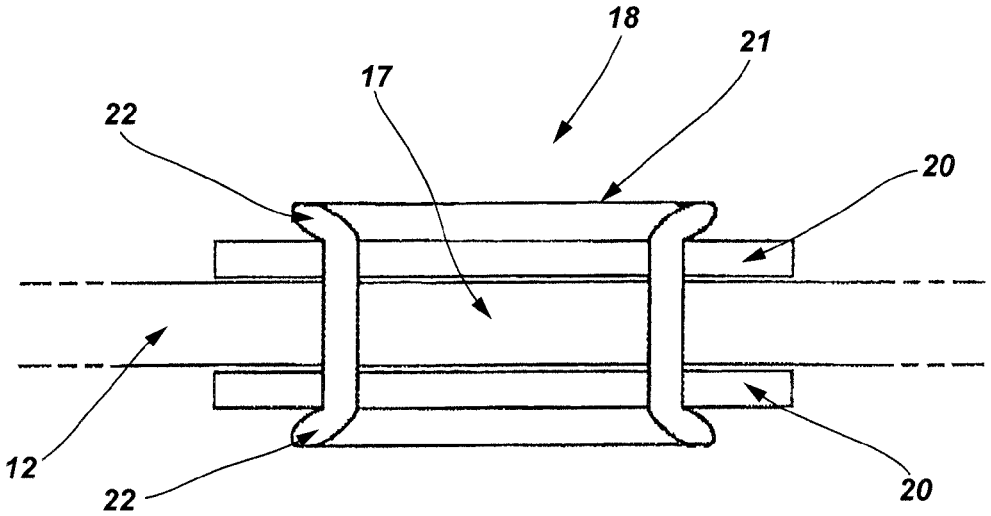
FIG. 3 is cross-sectional side elevation showing a detail of the eyelet for use in the temporary anchor shown in FIG. 1.

Referring to FIG. 3, there is shown a three-piece metal eyelet configuration, generally referenced 18, as used in the temporary anchor of FIG. 1. The eyelet 18 comprises two washers 20, which are caused to be pressed against either side of a hole 17 extending through a portion of webbing material 12, as described above. A ferrule member 21 is located through the hole 17 in the webbing 12 and by means of a press (not shown) has been bent at each end to form flanges 22, which secures the eyelet assembly 18 in place, thereby reinforcing the hole 17. The metal construction of the eyelet 18 not only provides stability to the holes 17 formed by separating the fibers, as described above, but also protects each hole 17 formed in the webbing 12, e.g., when inserting a screw therein (as shown in FIGS. 4 and 5), and, furthermore, also maintains the integrity of the webbing 12 in use so that it will not pull away from the head of the screw once fitted to a roofing structure.

Referring then to FIG. 4, there is shown schematically a temporary anchor 11 as described in FIGS. 2 through 3, attached to a roofing structure, in this case a batten 23 supporting a sheet of metal roof cladding 24. Batten 23 is shown schematically as both a metal batten 23*a* and a timber batten 23*b*. In each case, however, suitable hex-headed roofing screws 25 have been utilized, as is the norm. It is generally preferred that the screws in the timber batten 23*b* extend at least 35 mm into the batten 23, while in the case of the metal batten 23*a*, it is necessary to ensure that the threaded portion 26 of the screw 25 engages in the hole of the batten 23*a* without over extending as described earlier.

In either case, screws 25, which initially secured the roof cladding 24 to the respective batten 23*a*, 23*b*, have been removed and replaced after the temporary anchor 11 has been located thereon. Either the original screws 25 have been utilized or other screws 25 of the same gauge but of an appropriate length as described have been used.

The length of webbing 12 is allowed to simply "buckle up" or concertina along its length between respective screw attachment points.

With reference to FIG. 5, there is shown an attachment of a temporary roof anchor 11 to a pair of rafters 27, which have been exposed after a suitable number of tiles 28 have been removed. In this instance, it is preferred that the screws 25 be located at least 100 mm apart.

In either case, as illustrated in FIG. 4 or FIG. 5, if a sudden load is applied to the temporary anchor 11 as would occur from a person attached thereto falling from the roof, the bulk of the energy absorption will be initially taken up by the shock absorber 13 as it "unbends," as described above. If, for any reason, the first pair of screws 25 fail, the load will be progressively taken up by the next pair of screws 25, all the while the energy being dissipated as the fall, and hence the shock absorption, progresses. The provision of six screw holes 17 in the webbing 12 is to provide additional safety against failure.

Should the temporary anchor 11 be used in a fall, then it should be discarded. Otherwise, it may be removed by undoing the screws 25, taken away and, in the case of a metal roof as shown in FIG. 4, the original screws reinserted in the existing locations to once again secure the roof, or in the case of the tile roof shown in FIG. 5, the tiles placed back in position.

Figure 6:
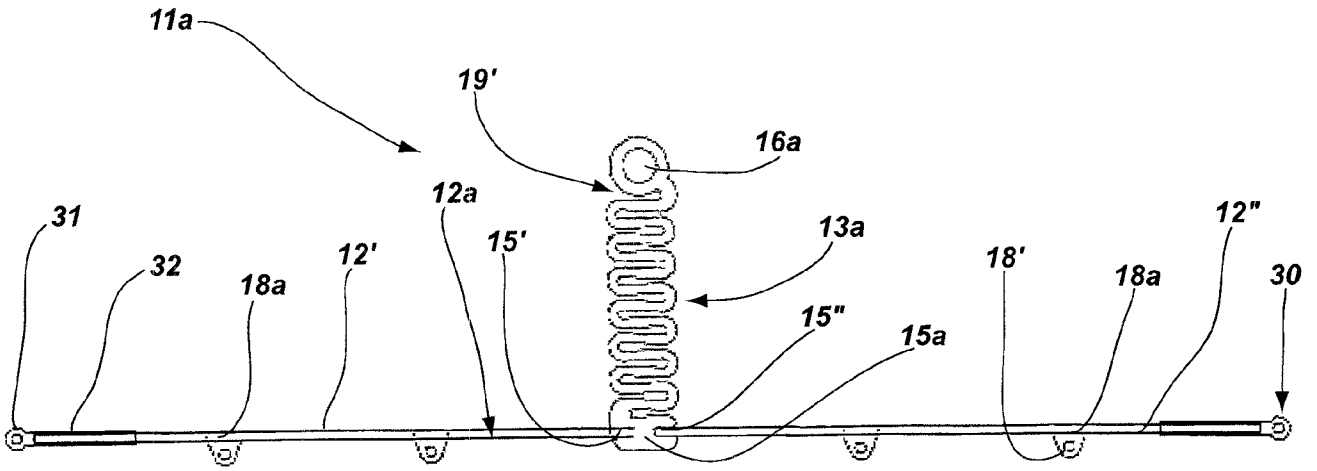
FIG. 6 is a schematic side view of a height safety anchor according to an improvement of the disclosure according to one embodiment.

Referring to FIG. 6, there is shown an improved height safety anchor 11*a* in which the webbing 12 of the height safety anchor 11 (shown in FIG. 1) is replaced with a metal cable, such as a stainless steel cable 12*a*. The metal cable 12*a* is flexible with high tensile strength. Mounted to the cable 12*a* is a shock absorber 13*a* that is similar in shape and function to the shock absorber 13. However, the shock absorber 13*a* is threaded onto the cable 12*a*, generally at cable's 12*a* mid-point, by threading the cable 12*a* through a pair of spaced apertures 15',15" located in an end plate 15*a* of the shock absorber 13*a*, whereafter the shock absorber 13*a* is generally fixed in position at some place along the length of the cable 12, for example, at its mid-point, when the cable 12*a* is generally straightened. The skilled person will appreciate that the flexible cable 12*a* may be manipulated to allow the shock absorber 13*a* to be shifted in position along the length of the cable 12*a*, as required. The apertures 15',15" are holes formed in the end plate 15*a*, so that the region of concertina-like bends 19*a* extend between the end plate 15*a* and a larger ring 16*a*, the large ring 16*a* being similar to the hole 16 of the shock absorber 13. A crook or space 19' is provided between the large ring 16*a* and a first fold of the concertinaed region 19*a* to permit increased flexibility of the large ring 16*a* relative to the folded portion 19*a* in the event of activation with a subject attached falling.

Figure 8:
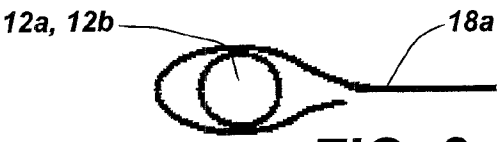
FIG. 8 is a cross sectional schematic view of a slidable eyelet mounted on a cable according to one embodiment.

Slidably mounted to the cable at intermittent locations along its length are a plurality of eyelets 18*a* that are loosely or closely pressed onto the cable 12*a* depending on application requirements and may be slidable along the cable's length. This may provide adjustability as to where the eyelets 18*a* are secured by fixing points or fasteners 25, as described with reference to the metal eyelets 18 of the height safety anchor 11. FIG. 8 provides an example of how the slidable eyelet 18*a* can be pressed on to the cable 12*a*. The fasteners 25 may be screws or other fixing means, such as clamps or bolts.

At either end of the cable 12*a*, a closed swage socket 30 is swaged onto the end of the cable 12*a* to form an end eyelet 31. The closed swage socket 30 comprises a swage sleeve 32 swaged to the end of the metal cable. The swage sleeve 32 may be internally threaded at its remote end and the end eyelet 31 may include a threaded bolt that can be threadably received in the swage sleeve 32 whereby end eyelets 31 may be replaced or substituted for different sized eyelets 31, or to replace damaged eyelets 31, for example, following activation of the height safety anchor 11*a* after a fall.

Figure 7:
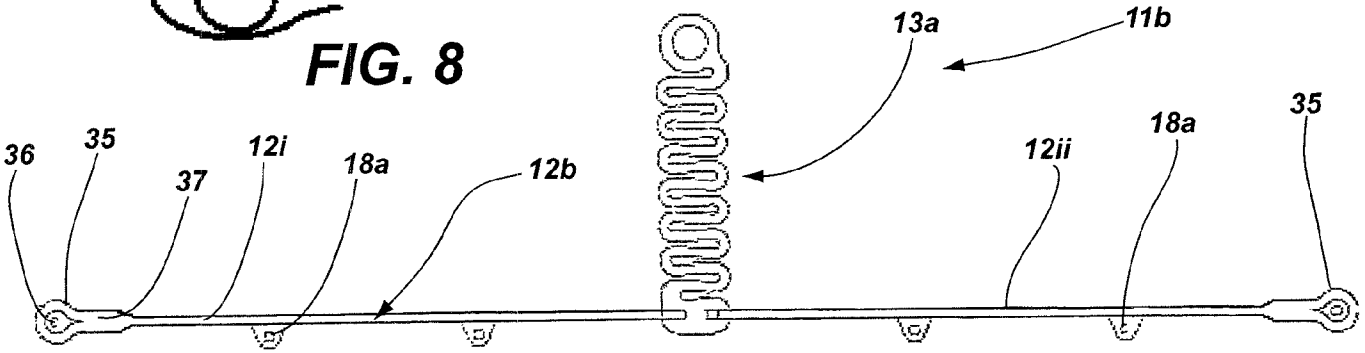
FIG. 7 is a schematic side view of a height safety anchor according to an improvement of the disclosure according to another embodiment.

FIG. 7 illustrates another improved height safety anchor 11*b* in which the same shock absorber 13*a* is used as that shown in FIG. 6 and the slidable eyelets 18*a* are also similar to that of the embodiment shown in FIG. 6. However, instead of the closed swage sockets 30 of the height safety anchor 11*a*, the height safety anchor 11*b* comprises open swage sockets 35 on the respective ends of a flexible metal cable 12*b*. The open swage sockets 35 are integrally or unitarily formed with respect to their respective swage sleeve 37 that is swaged onto the respective ends of the cable 12*b*, the end eyelet 36 being integrally formed with the swage sleeve 37.

Accordingly, in use the height safety anchors 11*a*, 11*b* are mounted to a building structure, such as that shown in FIG. 4 or FIG. 5. The advantage of the improved height safety anchors, 11*a*, 11*b*, is in the superior strength of the stainless steel cable, 12*a*, 12*b*, while retaining adequate flexibility with regard to ease of attachment to available fixing points on the building structure, particularly aided by the adjustability of the slidable eyelets 18*a* along its length. Preferably, as shown in FIGS. 6 and 7, four slidable eyelets 18*a* are provided intermediate the length of the cable, 12*a*, 12*b*. However, of course the number of eyelets 18*a*, 18*b* may be varied, together with the length of the cable 12*a*, 12*b*, depending on the application and the requirements of a particular installation, the typical length of cable being between 1-3 meters, and preferably, about 1.8-2 meters in length.

The provision of the apertures 15',15" in the end plate 15*a* of the shock absorber 13*a* allow the shock absorber 13*a* to be moved in position along the length of the flexible cable, 12*a*, 12*b*, so that a first length of cable 12' might be longer or shorter than the remainder or the second length of cable 12". Accordingly, both improved height safety anchors 11*a*, 11*b* have facility for adjustment in situ and the height safety anchor 11*a* further provides for replacement or interchangeability of the end eyelets 31.

Figure 9:
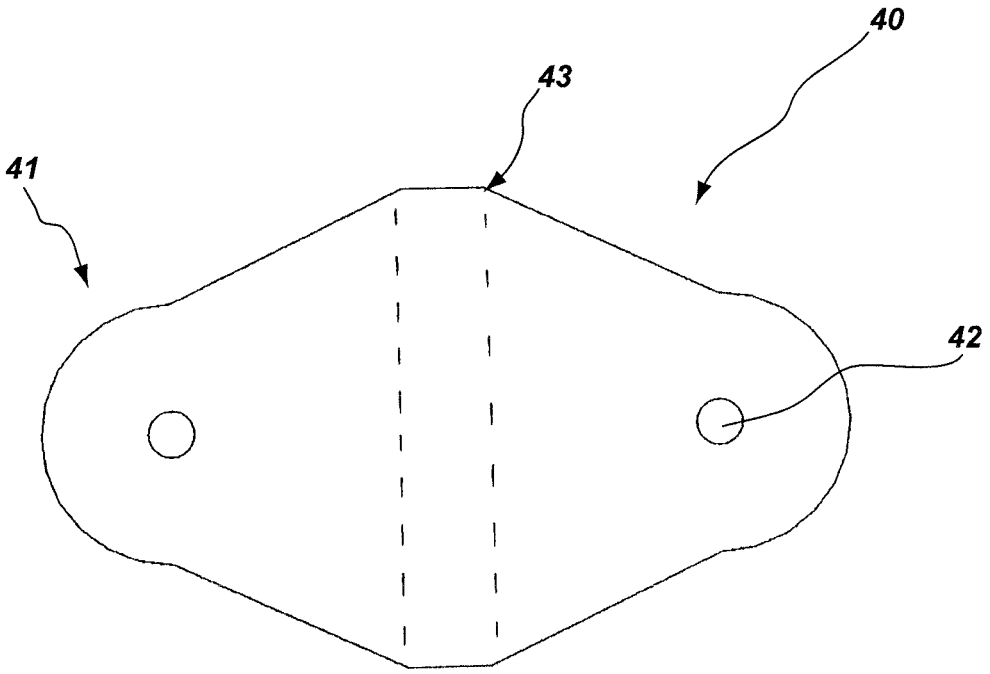
FIG. 9 is a top elevation of a pre-pressed slidable eyelet plate according to another aspect of the improvement of the disclosure.

In FIG. 9 there is shown a pre-pressed plate 40 that is used to form an eyelet 18*d*. The plate 40 is generally diamond shaped and has a pair of opposed rounded ends 41 in each of which there is centrally located an aperture 41. Extending between the rounded ends 41 is a broad plate region and a centrally located transverse channel section 43. In this embodiment of the eyelet 18*d*, the eyelet plate 40 is gripped at its ends 41 and pressed to fold and wrap around a cable 12" so that the cable 12" rests in a channel 43 formed as the walls of the plate 40 are folded towards one another and as the holes 42 are folded into registration with one another. The length of cable 12", secured in this manner, can then be fastened to a building supporting structure by inserting a fastener 25 through the holes 42 and fastened to the building supporting structure. The pressed fit of the slidable eyelet 40 may be sufficiently loose about the cable 12" so that the eyelet 40 is able to be adjusted in position along the length of the cable 12". Alternatively, the eyelet 40 may be secured by friction fit against sliding along the length of the cable 12" and may be loosened by slightly reversing the pressing process to release the friction grip of the eyelet channel 43 on the cable 12" to permit at least limited movement of the eyelet 40 along the length of the cable 12".

Figure 10:
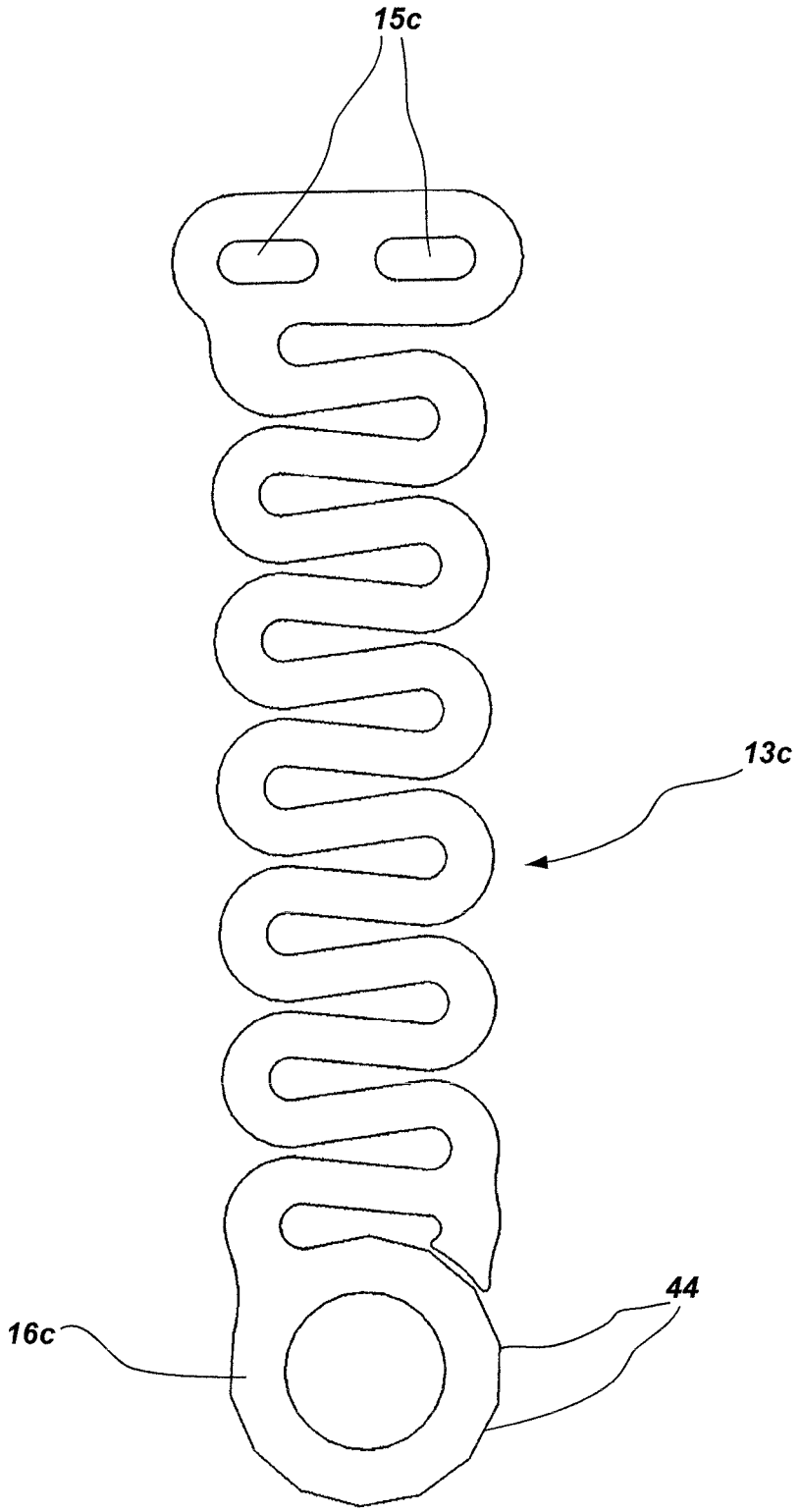
FIG. 10 is a top elevation of a shock absorber according to another aspect of the improvement of the disclosure.

Turning to FIG. 10, there is shown another version of the applicant's shock absorber 13*c*. The shock absorber 13*c* comprises slots to enable a cable 12" to be fed through the pair of apertures 15*c* to permit the cable to be advantageously fixed at a particular position on the length of the cable 12" and also to be loosened for adjustment along the length of the cable 12", when required. The first attachment loop 16*c* comprises flat outer edges to provide a graspable surface 44.

Figure 11:
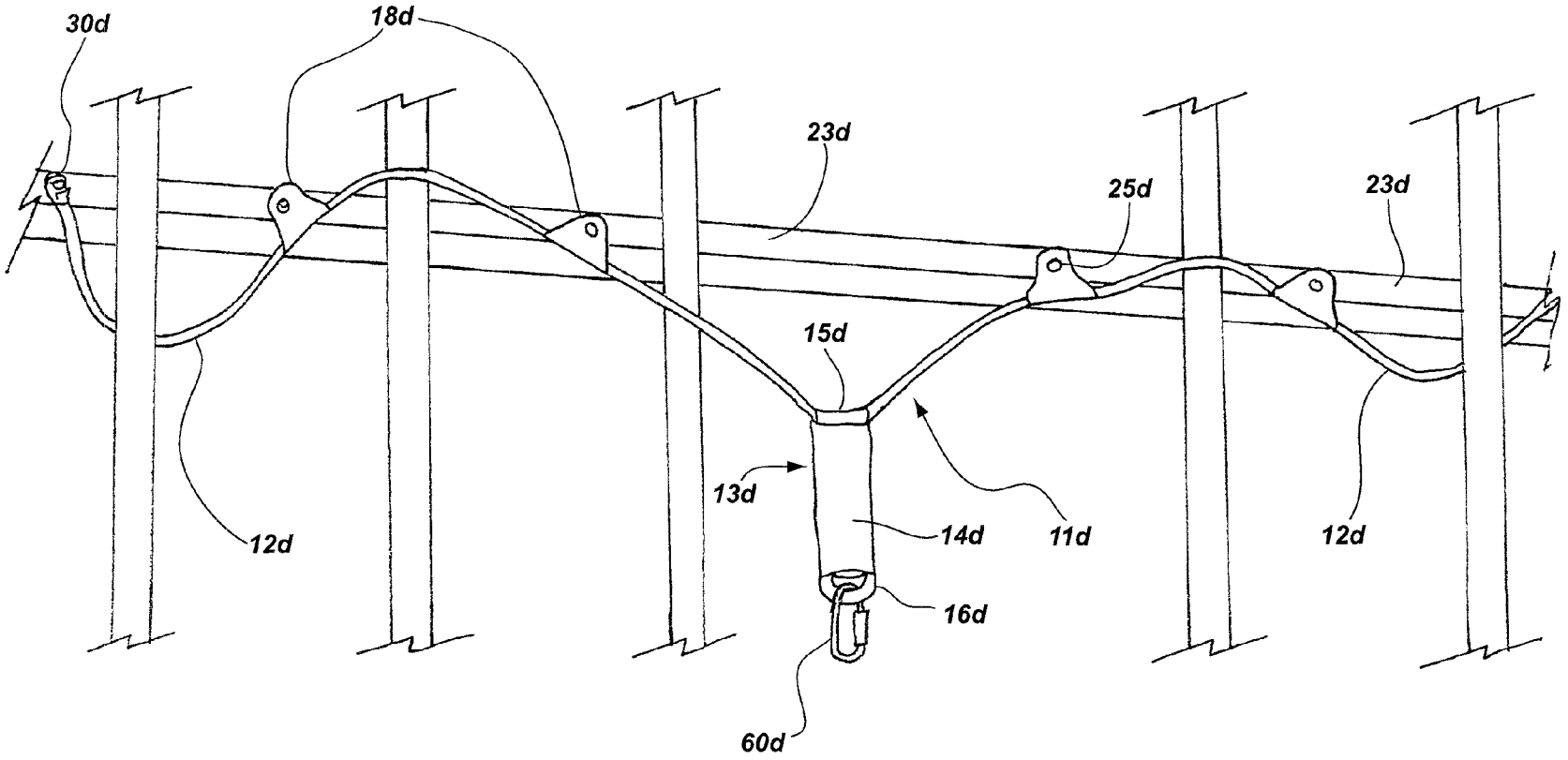
FIG. 11 is a schematic side view of the height safety anchor according to an improvement of the disclosure according to another embodiment.
Figure 12:
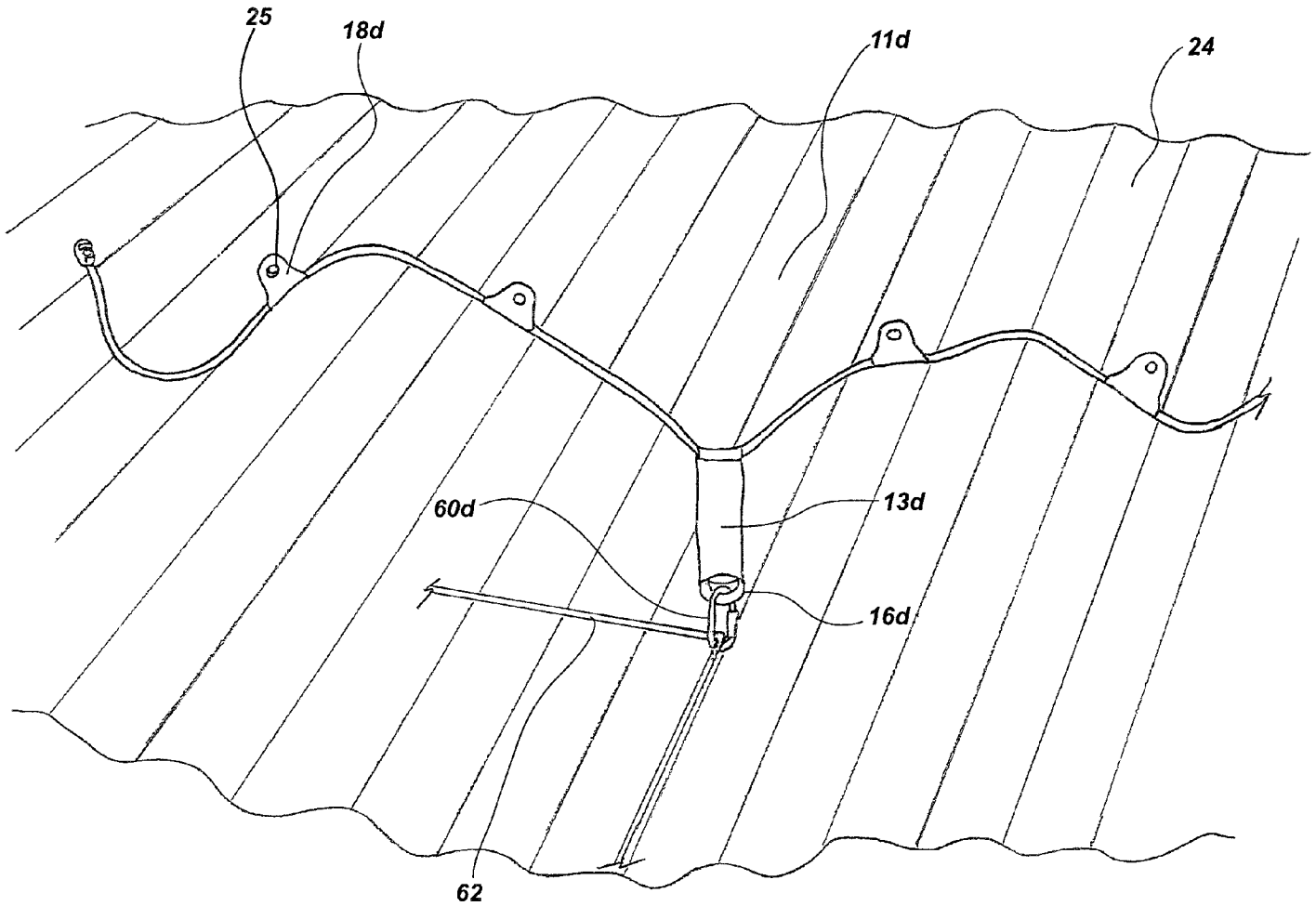
FIG. 12 is a perspective view of the height safety anchor attached to a roof according to another aspect of the improvement of the disclosure.

In FIGS. 11 and 12, a height safety anchor 11*d* similar to that shown in FIGS. 6 and 7 is provided. The height safety anchor 11*d* utilizes the pressed eyelet 18*d* formed from the plate 40 comprising a pair of apertures 42 and described in FIG. 9. As shown in FIG. 11, the height safety anchor 11*d* comprises a cable 12*d* made from stainless steel or galvanized cable that is flexible but possesses high tensile strength. The cable 12*d* is preferably sheathed with a protective plastic sleeve and terminates with a pair of terminal eyelets 30*d* in a manner similar to the embodiment shown in FIG. 6. The cable 12*d* is secured at multiple points, preferably 4 points, intermediate its length, spaced from each other, by slidable and adjustable eyelets 18*d* that are secured by fasteners 25 in the form of screws to a metal or wooden batten or rafter, or another suitable building support structure 23*d*.

Spaced upon approximately halfway between two innermost slidable eyelets 18*d* is a shock absorber 13*d* covered across its serpentine shock absorbing section by a sleeve 14*d*. A first end of the shock absorber 13*d* is threaded by the cable 12*d* through a pair of slots 15*d* similar to the slots 15*c* shown in FIG. 10. At its opposed end, a second attachment means 16*d* provides a loop for attachment of a carabiner 60*d* for the attachment of individual safety equipment.

In FIG. 12, the height safety anchor 11*d* of FIG. 11 is shown installed on a metal cladded roof 24. The eyelets 18*d* are secured through pre-formed registered holes in the metal cladding 24 to a rafter support (not shown). The fasteners 25 are typically and preferentially inserted at a high ridge point in the cladding where possible to minimize the risk of corrosion and roof leakage. Through a carabiner 60*d*, the height safety anchor 11*d* further has attached to its second attachment 16*d* a safety rope 62 to which a worker may be attached via their personal safety equipment, such as a harness (not shown).

It can be seen from FIGS. 11 and 12 that not only does the shock absorber 13*d* provide the potential for absorption of energy in the event of the application of a critical sudden load to the second attachment 16*d*, but the ability of the cable to slide against friction resistance and frictional forces applied by the slidable eyelets 18*d* also provide a means for absorption of kinetic energy applied through the second attachment.

It will appreciated that many modifications and variations may be made to the embodiment described herein by those skilled in the art without departing from the spirit or scope of the disclosure.

Throughout the specification and claims the word "comprise" and its derivatives are intended to have an inclusive rather than exclusive meaning unless the context requires otherwise.

In the present specification, terms such as "component," "apparatus," "means," "device" and "member" may refer to singular or plural items and are terms intended to refer to a set of properties, functions or characteristics performed by one or more items having one or more parts. It is envisaged that where a "component," "apparatus," "means," "device" or "member" or similar term is described as being a unitary object, then a functionally equivalent object having multiple components is considered to fall within the scope of the term, and similarly, where a "component," "apparatus," "assembly," "means," "device" or "member" is described as having multiple items, a functionally equivalent but unitary object is also considered to fall within the scope of the term, unless the contrary is expressly stated or the context requires otherwise.

Industrial Applicability

It will be immediately apparent to persons skilled in the art that the height safety anchor may provide an anchor point for a variety of activities carried out on buildings at height. For example, the height safety anchor may provide an anchor point for posts supporting fences or other barriers erected for the safety of workmen working on the building or may be used to secure equipment associated with the actual work on the building, notwithstanding that its primary function is to provide safety for persons engaged on working on a building.

What is claimed is:

1. A height safety anchor for fitment to a building support structure, the height safety anchor comprising:

a first attachment for fitment to the building support structure by engagement to a flexible and high tensile elongate member comprising a plurality of spaced eyelets that are slidable along the elongate member;

a second attachment remote from the first attachment for attaching safety equipment; and a shock absorber having a deformable region extending between the first and second attachments in a first length when not subject to a deformation force corresponding to a critical sudden load, the shock absorber lying substantially in a single plane and comprising a substantially rigid structure that, when subject to the critical sudden load, deforms, elongating to a greater length than the first length.

2. The height safety anchor of claim 1, wherein the elongate member comprises a cable.

3. The height safety anchor of claim 2, wherein the slidable eyelets comprise a loop surrounding a portion of the cable.

4. The height safety anchor of claim 3, wherein loop is a sleeve formed from a plate pressed onto and around the cable.

5. The height safety anchor of claim 1, wherein the cable is a metal cable.

6. The height safety anchor of claim 5, wherein the height safety anchor further includes end sockets swaged onto the ends of the metal cable.

7. The height safety anchor of claim 1, wherein the shock absorber comprises the first attachment that comprises a large ring.

8. The height safety anchor of claim 7, wherein the shock absorber comprises a series of folded portions forming a concertinaed length one end of which connects to one side of the large ring so that one section of the ring is positioned adjacent a straight edge of the last length of folded length of the series of folded portions.

9. The height safety anchor of claim 1, wherein the shock absorber engages the elongate member, which is fed through a pair of spaced holes formed in an end plate of the shock absorber.

10. The height safety anchor of claim 6, wherein the end sockets comprise eyelet bolts threaded into swaged end sleeves.

11. The height safety anchor of claim 1, wherein the deformable region is formed so that, when the deformation force is applied thereto, the deformation region unbends.

12. The height safety anchor of claim 1, wherein the critical sudden load is applied when a person attached to the second attachment falls from a height.

13. The height safety anchor of claim 4, wherein the cable is a metal cable.

14. The height safety anchor of claim 13, wherein the height safety anchor further includes end sockets swaged onto the ends of the metal cable.

15. The height safety anchor of claim 14, wherein the shock absorber engages the elongate member, which is fed through a pair of spaced holes formed in an end plate of the shock absorber.

16. The height safety anchor of claim 15, wherein the end sockets comprise eyelet bolts threaded into swaged end sleeves.

17. The height safety anchor of claim 16, wherein the deformable region is formed so that, when the deformation force is applied thereto, the deformation region unbends.

18. The height safety anchor of claim 17, wherein the critical sudden load is applied when a person attached to the second attachment falls from a height.

* * * * *